US011578420B2

(12) United States Patent
Jeon et al.

(10) Patent No.: US 11,578,420 B2
(45) Date of Patent: Feb. 14, 2023

(54) SURFACE HARDENING METHOD USING POST HEAT TREATMENT OF ALUMINUM ALLOY OXIDE LAYER

(71) Applicant: YKMC, Inc., Asan-si (KR)

(72) Inventors: Yoon Nam Jeon, Asan-si (KR); Na Gyeom Jeong, Pyeongtaek-si (KR); Sang Jun Kim, Cheonan-si (KR); Ji Hyun Park, Daegu (KR); Kwan Seop Jang, Pyeongtaek-si (KR)

(73) Assignee: YKMC, INC., Asan-si (KR)

( * ) Notice: Subject to any disclaimer, the term of this patent is extended or adjusted under 35 U.S.C. 154(b) by 333 days.

(21) Appl. No.: 16/923,679

(22) Filed: Jul. 8, 2020

(65) Prior Publication Data

US 2021/0054469 A1 Feb. 25, 2021

(51) Int. Cl.

| | |
|---|---|
| ***C25D 11/24*** | (2006.01) |
| ***C22C 21/00*** | (2006.01) |
| ***C23C 8/40*** | (2006.01) |
| ***C23C 8/80*** | (2006.01) |

(52) U.S. Cl.

CPC ..... *C25D 11/24* (2013.01); *C22C 21/00* (2013.01); *C23C 8/40* (2013.01); *C23C 8/80* (2013.01)

(58) Field of Classification Search

CPC ..... C25D 11/24; C22C 21/00; C23C 8/40; C23C 8/80

See application file for complete search history.

(56) References Cited

U.S. PATENT DOCUMENTS 4,235,682 A * 11/1980 Schneeberger ..... C25D 11/246 148/274

FOREIGN PATENT DOCUMENTS

| | | | | |
|---|---|---|---|---|
| KR | 10-1270671 B1 | | 6/2013 | |
| KR | 101270671 B1 | * | 6/2013 | ..... C25D 11/18 |
| KR | 10-1529888 B1 | | 6/2015 | |

* cited by examiner

*Primary Examiner* — Alexandra M Moore
(74) *Attorney, Agent, or Firm* — Polsinelli PC

(57) ABSTRACT

Provided is a surface hardening method for surface hardening a sulfuric acid-anodized aluminum alloy oxide layer, which includes: pre-treatment in which various foreign substances, including an oxide film, attached to a surface of an aluminum alloy are removed; sealing treatment in which the aluminum alloy having been subjected to the pre-treatment is immersed in a sealing solution, whereby fine pores formed in a film are sealed; and heat treatment in which the aluminum alloy having been subjected to the sealing treatment is charged to, and thermally treated in, a heat treatment furnace and then naturally cooled. By lowering the withstand voltage of an aluminum alloy oxide layer and increasing the hardness by subjecting the same to sealing treatment and subsequent post-heat treatment, the present invention has the effect of providing an environmentally-friendly and crack-free lightweight material that can replace steel products.

3 Claims, 2 Drawing Sheets
(2 of 2 Drawing Sheet(s) Filed in Color)

[FIG. 1]
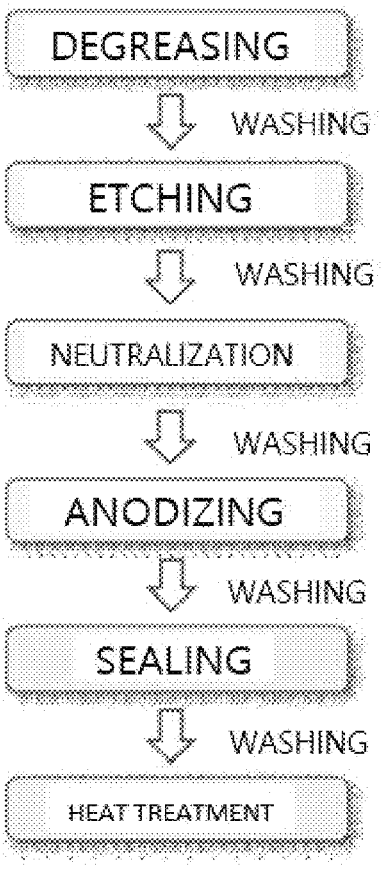

[FIG. 2]
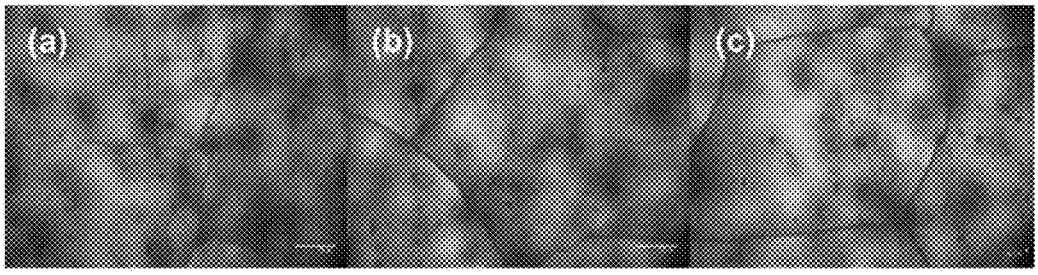
[FIG. 3]
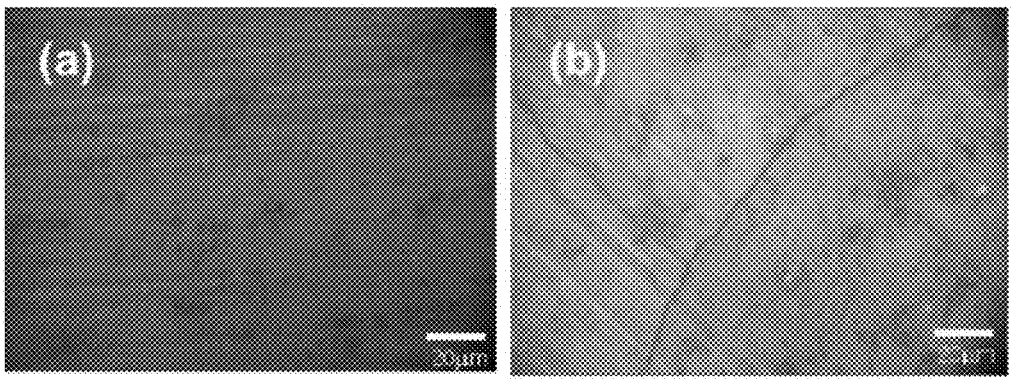

SURFACE HARDENING METHOD USING POST HEAT TREATMENT OF ALUMINUM ALLOY OXIDE LAYER

CROSS REFERENCE TO RELATED APPLICATION

This application claims priority to Application No. 10-2019-0101856 filed in Korea on Aug. 20, 2019. The entire contents of this application is hereby incorporated by reference.

TECHNICAL FIELD

The present invention relates to a method of surface hardening a sulfuric acid-anodized aluminum alloy oxide layer, and more particularly, to a surface hardening method using the post-heat treatment of an aluminum alloy oxide layer, which, by subjecting the aluminum alloy oxide layer to sealing treatment and subsequent post-heat treatment, enables the hardness of the oxide layer to be improved.

BACKGROUND ART

In general, aluminum anodizing is one of the surface treatment methods for forming an aluminum oxide film on the surface of aluminum, and it utilizes a phenomenon in which when an electric current is applied to a metal positive electrode, the surface of the metal is oxidized by oxygen generated at the positive electrode, and thereby an aluminum oxide film forms.

In addition, when the aluminum alloy material is subjected to anodizing treatment, an oxide film which has a diameter of several nanometers uniformly grows up to several tens of micrometers. The oxide film not only improves wear resistance due to having high hardness, but also improves the aesthetics of the surface and is very advantageous for corrosion resistance due to having the ability to prevent corrosion.

For the anodizing, a method using sulfuric acid as an electrolyte, which not only is inexpensive and has low power consumption but also produces a film with excellent wear resistance and excellent corrosion resistance, is mainly used, and recently, various techniques have been proposed to improve the performance and properties of aluminum alloy materials using electrolytes having different compositions.

However, an oxide film formed by the anodizing is porous, has an adsorptive characteristic and thus is easily soiled or sticks to the hand, and contains residues such as sulfuric acid inside pores thereof and thus may cause corrosion, and when colored, the dye may come off or fade. Therefore, sealing treatment is performed as a post-treatment process.

The above-described sealing treatment refers to a treatment for sealing fine pores of the anodized film and, at the same time, modifying physical properties such as corrosion resistance by filling the fine pores. As the sealing treatment, sealing by hydration which is carried out using boiling water or pressurized steam, metal salt sealing which is carried out using hot water containing a metal salt, and organic compound sealing which is carried out by applying or depositing an organic compound such as oil are known.

For example, Korean Patent Publication No. 2006-120949 discloses a sealing method for aluminum anodizing, which is carried out at 80 to 100° C. for 5 to 20 minutes using a sealing solution containing a nickel complex at 2 to 6 g/L, a cobalt complex at 1 to 3 g/L, and boric acid at 2 to 6 g/L and having a pH of 5 to 6.

However, when using the nickel salt, there is a risk that skin allergies, contact dermatitis, respiratory diseases, and the like may occur. Moreover, since 2012, nickel and its compounds are classified as water pollutants under the Enforcement Decree of the Water Quality and Ecosystem Conservation Act or the like in Korea and are regulated to be discharged at no more than 5 ppm.

In addition, in the case of the anodized aluminum alloys, not only is it not easy to create a uniform and beautiful color through surface treatment, but also there is a limitation in expressing various designs required for coverings for products by simple coloring. Therefore, there is an urgent need for research and development to improve various post-treatment processes, including the above-described sealing treatment.

RELATED-ART DOCUMENTS

Patent Documents (Patent Document 1) KR 10-1529888(B1) (registration date: 2015.06.12.)
(Patent Document 2) KR 10-1270671(B1) (registration date: 2013.05.28.)
(Patent Document 3) KR 10-2006-0120949(A) (publication date: 2006.11.28.)
(Patent Document 4) KR 10-2015-0029542(A) (publication date: 2015.03.18.)

DISCLOSURE

Technical Problem

The present invention is directed to providing a surface hardening method using the post-heat treatment of an aluminum alloy oxide layer, which, by subjecting the aluminum alloy oxide layer to sealing treatment and subsequent post-heat treatment, enables the hardness of the oxide layer to be improved.

Technical Solution

One aspect of the present invention provides a surface hardening method using the post-heat treatment of an aluminum alloy oxide layer, which includes: pre-treatment in which various foreign substances, including an oxide film, attached to a surface of an aluminum alloy are removed; sealing treatment in which the aluminum alloy having been subjected to the pre-treatment is immersed in a sealing solution, whereby fine pores formed in a film are sealed; and heat treatment in which the aluminum alloy having been subjected to the sealing treatment is charged to, and thermally treated in, a heat treatment furnace and then naturally cooled, wherein the sealing treatment is carried out at 80 to 90° C. for 15 to 30 minutes by immersing the aluminum alloy in the sealing solution, and the heat treatment is carried out at 100 to 400° C. for 30 to 120 minutes after charging the aluminum alloy in the heat treatment furnace.

Advantageous Effects

As described above, the present invention has at least the following effects.

First, by increasing the hardness of an aluminum alloy oxide layer by subjecting the same to sealing treatment and subsequent post-heat treatment, it is possible to provide an environmentally-friendly and crack-free lightweight material that can replace steel products.

Second, by applying an environmentally-friendly lithium salt to a sealing solution used in the sealing treatment of an aluminum alloy, not only is it possible to reduce the unit cost of the sealing solution, but also it is possible to improve the reliability of a final product manufactured using the aluminum alloy.

DESCRIPTION OF DRAWINGS

The patent or application file contains at least one drawing executed in color. Copies of this patent or patent application publication with color drawing(s) will be provided by the Office upon request and payment of the necessary fee.

FIG. 1 is a process flow diagram illustrating the processes of a surface hardening method of the present invention.

FIG. 2 is a set of photomicrographs of Al5052 having been subjected to a surface hardening method of the present invention.

FIG. 3 is a set of photomicrographs of Al6061 having been subjected to a surface hardening method of the present invention.

MODES OF THE INVENTION

Hereinafter, exemplary embodiments of the present invention will be described.

As shown in FIGS. 1 to 3, a surface hardening method using the post-heat treatment of an aluminum alloy oxide layer according to the present invention includes: pre-treatment in which various foreign substances, including an oxide film, attached to a surface of an aluminum alloy are removed; sealing treatment in which the aluminum alloy having been subjected to the pre-treatment is immersed in a sealing solution, whereby fine pores formed in a film are sealed; and heat treatment in which the aluminum alloy having been subjected to the sealing treatment is charged to, and thermally treated in, a heat treatment furnace and then naturally cooled.

Although the aluminum alloy is a lightweight material that has attracted attention as an alternative material for steel products, it has the disadvantage of having poor properties such as hardness and wear resistance compared to the steel products. Therefore, first, the present invention is directed to improving mechanical properties through sealing treatment and subsequent post-heat treatment of an oxide film formed through anodizing.

Meanwhile, in the related art similar to the present invention, there is a publication relating to the improvement of hardness through chromic acid sealing treatment and subsequent post-heat treatment, and the publication deals with a study that increased the hardness of a 5000 series aluminum alloy by allowing chromic acid to penetrate into cracks in the aluminum alloy.

On the other hand, the sealing solution used in the present invention is a lithium salt-based sealing solution which is an environmentally-friendly material and has a low unit price, and the aluminum alloy material used in the present invention is a 6000 series aluminum alloy which does not generate cracks.

That is, unlike the related art which has the disadvantage that the nickel plating or chrome plating used in the sealing treatment causes environmental problems, the present invention improved, compared to the related art, the hardness of anodized aluminum through environmentally-friendly lithium salt sealing treatment and subsequent post-heat treatment while maintaining similar levels of corrosion resistance and wear resistance.

As shown in Table 1, when the anodizing, the sealing treatment, and the subsequent heat treatment are sequentially performed, it was observed that a withstand voltage was significantly reduced (1,460 V→898 V) but hardness was significantly increased (357→479).

TABLE 1

| Sulfuric acid anodizing (30 μm) | Anodizing | Anodizing + sealing | Anodizing + sealing + heat treatment |
|---|---|---|---|
| Corrosion resistance to 5% HCl (min.) | 5 | 48 | 5 |
| Vickers hardness (HV) | 357 | 371 | 479 |
| Withstand voltage (V) | 1,460 | 1,230 | 898 |
| Amount of wear (μg/1,000 cycles) | 1,400 | 3,700 | 1,400 |

That is, as shown in Table 1, it is observed that in the present invention, since an aluminum alloy is subjected to the lithium salt sealing treatment and the subsequent post-heat treatment, hardness is greatly improved compared to "Anodizing" or "Anodizing+sealing."

When the present invention and "Anodizing" are compared, similar corrosion resistance and wear resistance are exhibited. However, when the present invention and "Anodizing+sealing" are compared, somewhat different corrosion resistance and wear resistance are exhibited, and in light of the fact that the amount of wear is reduced in the present invention, it can be seen that wear resistance is greatly improved.

The aluminum alloy oxide layer is entirely amorphous or has an amorphous structure with a small proportion of a crystal structure. If the proportion of a crystallized portion in the aluminum alloy oxide layer increases, since an improvement in properties of the oxide layer is expected, a method of increasing the proportion of a crystallized portion has been studied.

The crystallization of an aluminum alloy oxide layer is realized by an electron beam, but may also be realized by sealing treatment or heat treatment. Therefore, a change in physical properties due to the crystallization of an oxide layer by the post-heat treatment has been studied.

The above-described crystallization of an oxide layer is characterized in that the resistance of the oxide layer decreases, and the crystallization is confirmed through a decrease in the above-described withstand voltage. In light of the fact that although the withstand voltage is reduced, hardness is greatly improved through post-heat treatment, it can be seen that the desired purpose of the present invention is achieved.

Hereinafter, each process of the present invention will be described.

(1) Aluminum Alloy Material

As a material of the present invention, a 6000 series aluminum alloy is used. When a 5000 series aluminum alloy is used as in the related art, cracks are generated on a surface thereof during the post-heat treatment, which is undesirable.

(2) Pre-Treatment

The pre-treatment of the present invention is the process of removing various foreign substances formed on a surface of the aluminum alloy, and since degreasing, etching, and neutralization processes are sequentially performed as in the related art, the detailed description thereof will be omitted.

(3) Anodizing

The anodizing of the present invention is the process of forming an oxide film on a surface of the aluminum alloy, wherein a film having a thickness of 15 to 50 μm is formed in an electrolytic bath in a temperature range of −5 to 5° C. and containing a 15 to 20% aqueous sulfuric acid solution.

When the concentration of the aqueous sulfuric acid solution is 15% or less, it takes a long time to form a film, so film properties are degraded. On the other hand, when the concentration of the aqueous sulfuric acid solution is 20% or more, a film grows rapidly, so film properties are degraded. Therefore, the appropriate, preferred concentration of the aqueous sulfuric acid solution is 15 to 20%.

When the temperature of the electrolytic bath is −5° C. or less, the unit cost of production increases due to an increase in applied voltage, and when the temperature of the electrolytic bath is 5° C. or more, it is not easy to form a film having a thickness of 15 μm or more, and film properties are degraded. Therefore, the preferred temperature of the electrolytic bath is −5 to 5° C.

(4) Sealing Treatment

The sealing treatment of the present invention is the process in which an aqueous metal salt in the sealing solution enters fine pores of the oxide film and is hydrolyzed, and a hydroxide thereof precipitates, thereby sealing the pores. Here, the sealing treatment is performed by immersing the aluminum alloy in the sealing solution and then maintaining the same in a temperature range of 80 to 90° C. for 20 minutes.

Preferably, the sealing solution contains lithium carbonate ($LiCO_3$) at 1 to 50 g/L, sodium lauryl sulfate at 1 to 6 g/L, and an aqueous acetic acid solution at 1 to 6 g/L and has a pH of 5.0 to 6.0.

When the concentration of lithium carbonate is 1 g/L or less, it is required that immersion is performed for an extended time in the sealing treatment, and when the concentration of lithium carbonate is 50 g/L or more, there a risk that lithium carbonate may remain in the film and cause corrosion. Therefore, the preferred concentration of lithium carbonate is 1 to 50 g/L.

As an organic compound of the sealing solution, sodium lauryl sulfate is used at 1 to 6 g/L, and as an acid of the sealing solution, an aqueous acetic acid solution is used at 1 to 6 g/L.

When the pH of the sealing solution is 5 or less, boehmite is formed on, and adversely affects, a surface of the film during the sealing treatment, and when the pH is 6 or more, sealing smut is formed. Therefore, the pH of the sealing solution is limited to a range of 5 to 6.

(5) Post-Heat Treatment

The post-heat treatment of the present invention is the process of putting the aluminum alloy in a heat treatment furnace, heating the same to a desired temperature, and maintaining the same for a predetermined period of time. The post-heat treatment is performed under the condition of heating the aluminum alloy in a temperature range of 100 to 400° C. for 30 to 120 minutes, and after the post-heat treatment is completed, the aluminum alloy is naturally cooled at room temperature.

When the temperature of the post-heat treatment is 100° C. or less, the effect of the heat treatment is not exhibited, and when the temperature of the post-heat treatment is 400° C. or more, cracking occurs. Therefore, the temperature of the heat treatment is limited to a range of 100 to 400° C.

When the time of the post-heat treatment is 30 minutes or less, the effect thereof is insignificant, and when the time of the post-heat treatment is 120 minutes or more, there is a risk that cracking may occur. Therefore, the time of the post-heat treatment is limited to a range of 30 to 120 minutes.

Example 1

First, a 30 μm film was formed on an Al5052 specimen in a −3° C. electrolytic bath containing 20% sulfuric acid, and then the specimen was subjected to sealing treatment by being immersed in an 80° C. sealing solution for 20 minutes. As a result of thermally treating the specimen at 100° C. for one hour, 200° C. for one hour, or 300° C. for one hour, it was observed that cracks were generated on a surface of the film as shown in the photomicrographs of FIG. 2.

FIG. 2A is a photomicrograph showing the result of heat treatment performed at 100° C. for one hour, FIG. 2B is a photomicrograph showing the result of heat treatment performed at 200° C. for one hour, and FIG. 2C is a photomicrograph showing the result of heat treatment performed at 300° C. for one hour.

Therefore, it can be seen that the use of such a 5000 series aluminum alloy is undesirable, since cracking occurs as shown in FIG. 2.

Example 2

First, a 50 μm film was formed on an Al6061 specimen in a −5° C. electrolytic bath containing 17% sulfuric acid, and then the specimen was subjected to sealing treatment by being immersed in an 83° C. sealing solution for 20 minutes. After thermally treating the specimen at 280° C. for 120 minutes, the hardness and withstand voltage of the heat-treated material were measured.

The hardness of the heat-treated material was measured four times, and the results were 416, 424, 401, and 412 HV. The withstand voltage of the heat-treated material was measured four times, and the results were 1,212, 1,666, 1,410, and 1,461 V.

Example 3

First, a 30 μm film was formed on an Al6061 specimen in a 3° C. electrolytic bath containing 17% sulfuric acid, and then the specimen was subjected to sealing treatment by being immersed in an 83° C. sealing solution for 20 minutes. After thermally treating the specimen at 280° C. for 120 minutes, the hardness of the heat-treated material was measured.

The hardness of the heat-treated material was measured four times, and the results were 390, 432, 401, and 435 HV.

Example 4

First, a 30 μm film was formed on an Al6061 specimen in a −5° C. electrolytic bath containing 17% sulfuric acid, and then the specimen was subjected to sealing treatment by being immersed in an 85° C. sealing solution for 20 minutes. After thermally treating the specimen at 360° C. for one hour, the structure of the heat-treated material was evaluated.

As a result of evaluating the structure of the heat-treated material, the absence of cracks or the presence of fine cracks was observed, as shown in the photomicrographs of FIG. 3.

FIG. 3 is a set of photomicrographs showing the result of heat treatment performed at 360° C. for one hour, wherein FIG. 3A shows a surface without cracks, and FIG. 3B shows a surface with cracks.

In addition, the hardness of the heat-treated material was measured four times, and the results were 471, 544, 472, and 459 HV. The withstand voltage of the heat-treated material was measured six times, and the results were 886, 802, 875, 939, 915, and 927 V. The wear amount of the heat-treated material was measured twice, and the results were 1,400 and 1,300 μg. The heat-treated material was evaluated by a 5% HCl bubble test, and it took 5.1 and 5.0 minutes for the bubbles to form.

Example 5

First, a 43 μm film was formed on an Al6061 specimen in a −5° C. electrolytic bath containing 17% sulfuric acid, and then the specimen was subjected to sealing treatment by being immersed in an 83° C. sealing solution for 20 minutes. After thermally treating the specimen at 360° C. for one hour, the hardness, withstand voltage, and wear amount of the heat-treated material were measured.

The hardness of the heat-treated material was measured four times, and the results were 501, 479, 497, and 440 HV. The withstand voltage of the heat-treated material was measured six times, and the results were 1,102, 1,061, 979, 959, 1,047, and 1,010 V. The wear amount of the heat-treated material was measured twice, and the results were 1,200 and 1,500 μg.

Therefore, it can be seen that in the present invention, since the sealing treatment and the subsequent post-heat treatment are applied in the surface treatment of the 6000 series aluminum alloy, it is possible to develop a lightweight aluminum alloy material in which cracking does not occur on a surface of the aluminum alloy and which has improved hardness and thus can replace steel products.

The above description is merely illustrative of the present invention, and a person skilled in the art to which the present invention pertains may modify the above-described embodiments without departing from essential characteristics of the present invention. Therefore, the scope of the present invention should not be construed as being limited to the above-described embodiments but should be construed as including various embodiments within the scope equivalent to those described in the claims.

The invention claimed is:

1. A surface hardening method using post-heat treatment of an aluminum alloy oxide layer, comprising:

pre-treatment in which various foreign substances, including an oxide film, attached to a surface of an aluminum alloy are removed;

sealing treatment in which the aluminum alloy having been subjected to the pre-treatment is immersed in a sealing solution, whereby fine pores formed in a film are sealed; and heat treatment in which the aluminum alloy having been subjected to the sealing treatment is charged to, and thermally treated in, a heat treatment furnace and then naturally cooled;

wherein the sealing treatment is carried out at 80 to 90° C. for 15 to 30 minutes by immersing the aluminum alloy in the sealing solution, and the heat treatment is carried out at 100 to 400° C. for 30 to 120 minutes after charging the aluminum alloy in the heat treatment furnace.

2. The surface hardening method of claim 1, wherein the aluminum alloy is a 6000 series aluminum alloy.

3. The surface hardening method of claim 1, wherein the sealing solution contains lithium carbonate at 1 to 50 g/L, sodium lauryl sulfate at 1 to 6 g/L, and an aqueous acetic acid solution at 1 to 6 g/L and has a pH of 5.0 to 6.0.

* * * * *